US008967297B2

(12) United States Patent
Orban et al.

(10) Patent No.: US 8,967,297 B2
(45) Date of Patent: Mar. 3, 2015

(54) WELL CONSTRUCTION USING SMALL LATERALS

(75) Inventors: Jacques Orban, Cheltenham (GB); Claude Vercaemer, Paris (FR); Sami Iskander, London (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 1008 days.

(21) Appl. No.: 12/674,575

(22) PCT Filed: Aug. 23, 2007

(86) PCT No.: PCT/RU2007/000455

§ 371 (c)(1),
(2), (4) Date: Nov. 10, 2010

(87) PCT Pub. No.: WO2009/025574

PCT Pub. Date: Feb. 26, 2009

(65) Prior Publication Data

US 2011/0061937 A1 Mar. 17, 2011

(51) Int. Cl.
*E21B 7/00* (2006.01)
*E21B 41/00* (2006.01)
*E21B 43/30* (2006.01)

(52) U.S. Cl.
CPC ..... *E21B 41/0035* (2013.01); *E21B 43/305* (2013.01)
USPC ..... 175/62; 166/270

(58) Field of Classification Search
CPC ..... E21B 43/16; E21B 43/162; E21B 43/32
USPC ..... 166/50, 300, 270; 175/61, 62; 405/51
See application file for complete search history.

(56) References Cited

U.S. PATENT DOCUMENTS 2,434,239 A * 1/1948 Zublin ..... 166/278
4,022,279 A * 5/1977 Driver ..... 166/271
4,605,076 A * 8/1986 Goodhart ..... 175/61
4,658,916 A * 4/1987 Bond ..... 175/81
(Continued)

FOREIGN PATENT DOCUMENTS

RU 2205935 C1 6/2003
RU 2256069 C1 7/2005
(Continued)

OTHER PUBLICATIONS

A.G. Kalinin, et al., "Burenie Naklonnykh i gorizontalnykh skvazhyn," Spravochnik, M., Nedra, 1997, pp. 148-157.
(Continued)

*Primary Examiner* — Blake Michener
*Assistant Examiner* — Kipp Wallace
(74) *Attorney, Agent, or Firm* — Chadwick A. Sullivan; Wesley Noah

(57) ABSTRACT

This invention relates to the construction of well such as oil and gas wells using techniques based on drilling small lateral wells from a main well. The problem of narrow pressure window is solved by the use of constructions techniques that are based on the use of lateral boreholes, i.e. secondary boreholes that are drilled a main borehole, wherein a method of constructing a well comprises drilling a main borehole extending from the surface through one or more underground formations, drilling a plurality of lateral boreholes extending from the main borehole into surrounding formations, wherein the lateral boreholes are substantially shorter and of smaller diameter than the main borehole; and wherein each lateral borehole is separated from its neighboring lateral boreholes by a relatively short distance. Drilling of the lateral boreholes can be for to extend 5-60 meters from the main borehole with a diameter in the range 3.8-10 cm by the lateral boreholes at an axial spacing of less than a few meters in the main borehole. Drilling of more than one lateral borehole can be done at the same depth in the main borehole with a trajectory that deviates from the main borehole by less than 10° or with trajectories that extend in a plane that does not contain the main borehole.

17 Claims, 13 Drawing Sheets

(56) References Cited

U.S. PATENT DOCUMENTS

| | | | | |
|---|---|---|---|---|
| 4,662,449 | A * | 5/1987 | Friedman | 166/295 |
| 5,469,925 | A * | 11/1995 | Mueller et al. | 175/61 |
| 5,785,133 | A | 7/1998 | Murray et al. | |
| 7,131,493 | B2 * | 11/2006 | Eoff et al. | 166/295 |
| 7,159,661 | B2 * | 1/2007 | Restarick et al. | 166/313 |
| 2003/0221836 | A1 | 12/2003 | Gardes | |
| 2004/0003925 | A1 * | 1/2004 | Desai | 166/313 |
| 2004/0035582 | A1 | 2/2004 | Zupanick | |
| 2006/0048946 | A1 * | 3/2006 | Al-Muraikhi | 166/369 |
| 2007/0068674 | A1 * | 3/2007 | Turta et al. | 166/270 |
| 2007/0181308 | A1 * | 8/2007 | Jelsma | 166/313 |

FOREIGN PATENT DOCUMENTS

| | | |
|---|---|---|
| RU | 2283417 C1 | 9/2006 |
| WO | 00/46484 | 8/2000 |
| WO | 2005/078236 | 8/2005 |

OTHER PUBLICATIONS

Office action for the equivalent Chinese patent application No. 200780101192.3 issued on Apr. 7, 2013.

Office action for the equivalent Chinese patent application No. 200780101192.3 issued on Oct. 31, 2013.

T. Cavender, "Summary of Multilateral Completion Strategies Used in Heavy Oil Field Development", SPE International Thermal Operations and Heavy Oil Symposium and international Horizontal Well Technology Conference, Mar. 16, 2004, pp. 1-10.

Search report for the equivalent European patent application No. 07870608.2 issued on Sep. 18, 2014.

* cited by examiner

WELL CONSTRUCTION USING SMALL LATERALS

TECHNICAL FIELD

This invention relates to the construction of well such as oil and gas wells using techniques based on drilling small lateral wells from a main well.

BACKGROUND ART

Well construction has a number of well-known problems that can affect the ability to recover oil from the formation through which the well is drilled, or even, in extreme, circumstances to complete the well and bring it to production.

When drilling horizontal wells in oil-bearing formations, a key factor for success is to try to keep the well a constant distance above the water table that underlies the oil. When this is not achieved and the well trajectory varies, the low points or 'valleys' of the well are often sources of problem. If open-hole completion is used or if the perforation density in that region is uniform, there is a high risk of water coning towards the well valley. Even with cased hole and no perforation in the valleys, some lengths of well can still lose contact with the reservoir. In rare situations, a drilled section of well must be abandoned and side-tracking is performed to re-position the well at the correct depth.

A similar problem may appear in the "up-hill" part of the well when the distance from the well to gas layer overlying the oil is too small. In this case gas can then be produced, with similar consequence and treatment as the "valley" and water problem described above.

In some wells, the drilling process itself generates some formation damage in the near well-bore region. This appears as a high skin effect with a consequential production limitation. Certain chemical treatments have previously been proposed to be performed in the rock matrix for cleaning the rock pores and re-establishing the proper permeability but these are not always effective.

For sand control during production, the common solution is to use gravel packing and screens. In horizontal wells, the placement of the gravel can be quite challenging, while at the same time reducing the flow section (the open bore of the well) in the completion. For completions based on gravel packing and fracturing ("Pack&Frac" technique), there can be difficulties with the placement of the pack, and there is no control of the direction of the short fractures produced.

For the problem of formation collapse due to stresses in the rock (and stress concentration near the well bore), the only solutions are either to adapt mud density used during the drilling of the well with risk of fracturing other layers, or to abandon this section of the well and restart with another well bore trajectory.

For loss of drilling fluid while drilling, the problem is often solved by placing some cement slurry at the bottom of well and squeezing part of it in the formation. However, the resulting treatment is often not very deep and when the drilling is reinitiated across the cement plug, the well bore can enter virgin formation again, and losses often restart.

The problem of narrow pressure window is often difficult to solve: there is limited freedom to adjust mud density while avoiding formation fracturing or influx of formation fluid in the well-bore. Often a casing has to be installed to isolate that formation.

It is an object of the invention to provide constructions techniques that are alternatives to these treatments of methods and which can potentially overcome some or all of the problems. The invention is based on the use of lateral boreholes, i.e. secondary boreholes that are drilled from a main borehole. Laterals have been previously proposed for various uses, in particular for providing improved contact with the formation.

DISCLOSURE OF THE INVENTION

One aspect of this invention provides a method of constructing a well, comprising:

drilling a main borehole extending from the surface through one or more underground formations; and drilling a plurality of lateral boreholes extending from the main borehole into surrounding formations;

wherein the lateral boreholes are substantially shorter and of smaller diameter than the main borehole; and wherein each lateral borehole is separated from its neighbouring lateral boreholes by a relatively short distance.

The lateral boreholes preferably extend 5-30 meters from the main borehole and have a diameter in the range 3.8-10 cm.

The lateral boreholes are typically drilled at an axial spacing of less than a few meters in the main borehole and more than one lateral borehole can be drilled at the same depth in the main borehole.

In one preferred embodiment, the lateral boreholes are drilled with a trajectory that deviates from the main borehole by less than 10°. In another, the lateral boreholes can extend essentially perpendicular to the main borehole.

In certain cases, it can be preferable to drill the lateral boreholes with trajectories that extend in a plane that does not contain the main borehole. The lateral boreholes can have an S-shape or spiral around the main borehole.

A preferred use of the method comprises drilling the lateral boreholes so as to extend through a region of modified formation properties surrounding the main borehole, such as skin or drilling damage, into a region beyond which has substantially bulk formation properties.

The lateral boreholes can be filled with gelled fluid after drilling so as to prevent contamination of the lateral boreholes with fluids from the main borehole. The method can also include breaking the gel of the fluid in the lateral boreholes so as to obtain access to the interior of the lateral boreholes.

Another embodiment of the method comprises substantially filling the whole of the lateral boreholes with gravel. Preferably, the gravel is stabilised at the region of the lateral boreholes close to the main borehole so as to prevent gravel from passing into the main borehole.

Each lateral borehole can be filled with gelled fluid or gravel immediately after it has been drilled and before another lateral borehole is drilled or one after the other following drilling of all of the lateral boreholes.

The main borehole can be completed in the region from which the lateral boreholes extend by means of a gravel pack and screen, an expandable screen, a slotted liner or cemented casing.

Methods according to the invention can also further comprise pumping a formation treatment fluid through the lateral boreholes so as to modify the formation properties near the well. The treatment fluid can be pumped into the formation to modify its permeability to restrict flow of water or gas into the well, or to stabilise its mechanical properties during the drilling process.

MODE(S) FOR CARRYING OUT THE INVENTION

This invention is based on the concept of multiple small laterals drilled from parent, wells or boreholes. This invention also includes treatments which can be performed in and from the small lateral to adapt or correct the performance of the main well, the formation properties, the formation fluids and the change of porosity and permeability of the formation. The laterals are typically 5 to 30 m long (compared to main borehole depths of several thousand meters), and of 1.5 to 4 inch (3.8-10 cm) diameter (compared to main borehole diameters typically in the range 20-40 cm). The trajectory of these laterals can be either nearly parallel to main well, with deviations below 10°) or as deviated as possible (perpendicular) from the main well. The distances between successive lateral junctions to the parent well can be fairly small: that axial spacing could be as close as zero (i.e. more than one lateral borehole at the same depth) with the lateral boreholes at different azimuths. Several laterals can be drilled for every meter of main well (when rock strength is not a limitation). The laterals can be S-shaped or a spiral around the main well in certain cases.

The new treatments which are provided by this invention are based on fluid or slurry placement techniques in the lateral or in matrix treatment from the laterals. For example:

- Filling the small lateral with gelled fluid, to avoid pollution of the laterals from the main borehole during future operations.
- Filling the lateral with gravel for the purpose of sand management. As multiple laterals are treated, the global results can provide improvement over conventional "Pack&Frac" or "sand management" in long horizontal drains.
- Matrix treatments via the laterals to solve drilling problems, e.g. control of drilling fluid loss, management of kicks and influxes, rock strengthening, etc.
- Matrix treatments to solve production problems, such as water arrival in horizontal wells, or re-development of contact with the reservoir at proper depth when in valleys or hills of a horizontal well.
- Improvement of productivity (PI), by passing skin layer and limiting pressure draw-down and its risk of PVT transition.

Figure 1:
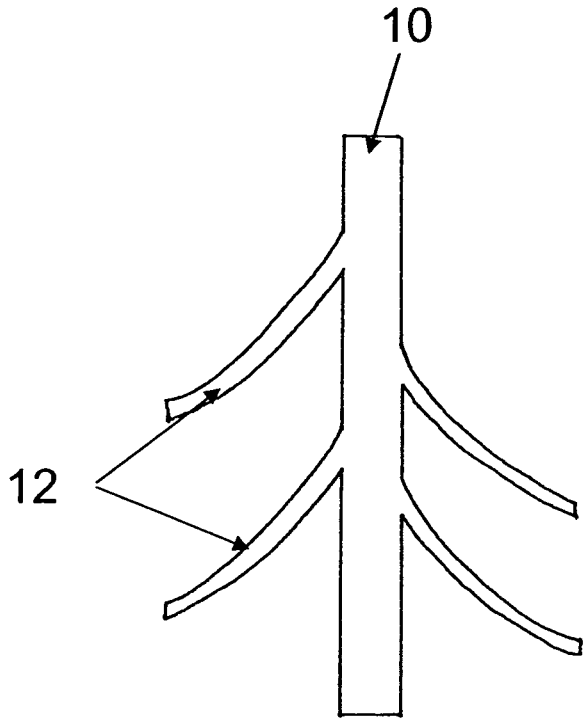
FIGS. 1 and 2 show simplified views of wells drilled in accordance with the invention.
Figure 2:
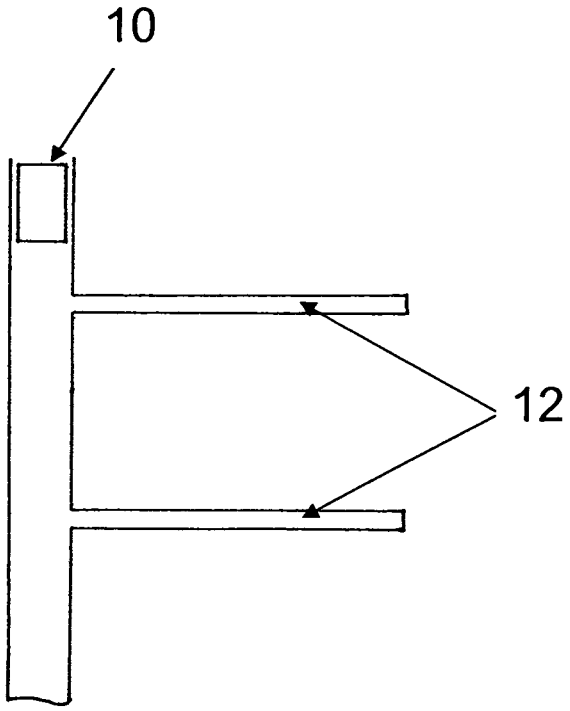

FIGS. 1 and 2 show a main borehole 10 can be provided with multiple lateral boreholes 12 closely spaced together. In many cases, a conventional curved trajectory can be used for the laterals 12 (see FIG. 1) giving a fishbone arrangement when seen in two dimensions. It may also be useful for the laterals 12 to extend directly away from the main borehole 10 as is shown in FIG. 2. The laterals may be placed at different angle with the main well.

Figure 3:
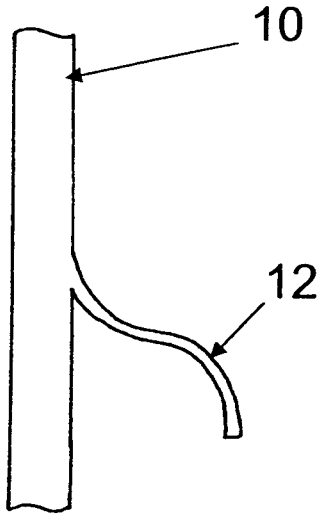
FIGS. 3 and 4 show different forms of lateral well.
Figure 4:
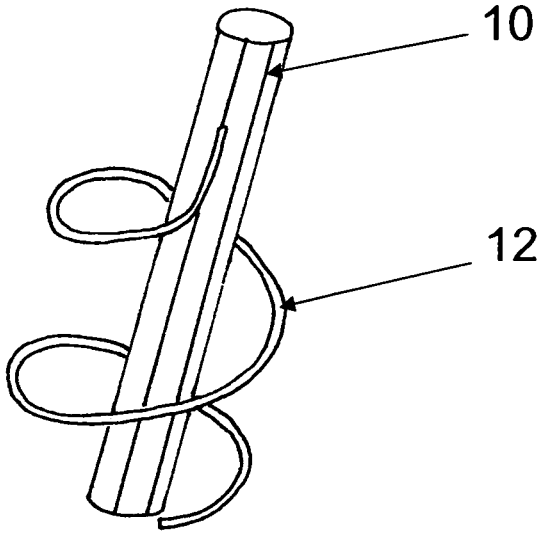

For some formation treatments, other well trajectories may be adopted such as those shown in FIGS. 3 and 4. FIG. 3 shows S-shaped laterals 12 can insure a contact with the reservoir which could be more "parallel" to the main borehole 10. This can be advantageous for example for treatments near a horizontal main borehole.

The spiral shape lateral 12 shown in FIG. 4 can be advantageous for axisymmetrical treatment around the main borehole 10. This may be beneficial when applying treatments in the near-well bore region.

Figure 5:
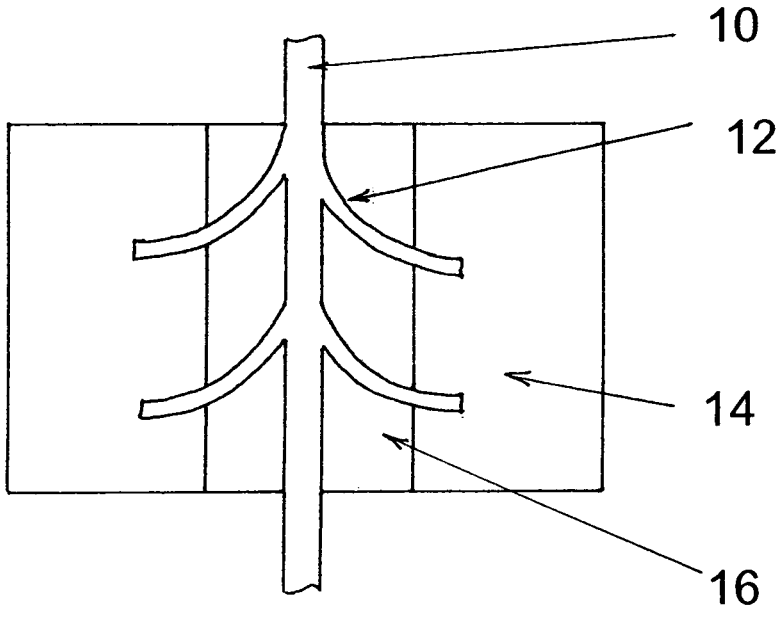
FIG. 5 shows treatment and improved contact with of a formation in accordance with one embodiment of the invention.

The well production can be increased via a larger contact surface to the reservoir. Furthermore the contact can be insured at a fair distance form the main well bore, so that the pressure drawdown due to the concentric flow is limited. This can be particularly useful where high skin is present and where the formation fluid is heavy oil. FIG. 5 shows such an implementation. In this case, the small laterals 12 are drilled from the parent well 10 a sufficient distance into the formation 14 so as to pass through the skin 16 around the parent well 10 with high pressure loss characteristics and into formation 14 displaying proper, bulk properties.

The well production can also be increased with the help of small laterals in the situation of horizontal hole drilled for production of reservoir formed by lenses separated by insulating shale. Each little laterals may contact multiple lenses increasing drastically the recovery.

The well production can also be increased with the help of small laterals when producing highly fractured reservoir via a single main quasi vertical well: the laterals may be drilled in direction nearly perpendicular to the factures to insure more interconnections.

In one embodiment of the invention, the laterals are filled with gelled fluid after its drilling. Thanks to this fluid, the lateral will not be polluted by other fluids such as drilling mud and/or cement slurry in the parent well, the lateral staying clean until needed for later use. The gelled fluid can be placed in the lateral as a fluid pill by the tool which has been used to drill that lateral before it is moved to another location. For example, the main well can be drilled to target depth (TD); then multiple small laterals are drilled and filled with gel. Then casing and cementing isolation can be performed for the main well. Finally high density perforation can be performed to connect the laterals to the main well to insure better drainage of the reservoir.

Breaking of the gelled fluid to allow clean-up of the laterals can be due to time. Other methods can also be used, such as injection of an appropriate breaker fluid into the lateral, similar to techniques used for breaking gelled fracturing fluid.

In one embodiment of the invention, the whole volume of the lateral is filled with gravel, such as is used for gravel packing. This is different to the conventional gravel packing, where the centre of the well is kept open by the screen. The produced fluid enters the lateral and then flows to the main well via the packing in the lateral. This packing preferably has permeability properties similar to fracturing with proppant. However, in this application, the gravel is not submitted to the high closing stresses as are present in fractures. This gives more freedom to select the gravel. The main properties of interest are:

- Screening against the flow of formation sand.
- High axial permeability.
- Gravel stability at the top of the lateral.

It is preferred that gravel used to pack the lateral should not be entrained into the parent well. To achieved this effect, the upper part of the lateral may be packed with gravel containing fibres, rough gravel, piece of cloth, sand covered with resin, etc. to stabilise the pack. This may only be necessary for the last few meters of the lateral near the junction.

For this treatment, the laterals may be advantageously steered away from the main well (as perpendicular as possible) to reduce the pressure draw-down in the reservoir.

The packing of each well can be performed when the drilling system used to drill the laterals is still in place. However in this situation, the circulation of the small slurry volume to the bottom of the main well for packing may require a long time as the main well can be relatively deep. To avoid the repeated loss of time for individual treatment of each of the laterals, it may be preferred to place the packing in all laterals in one step. For this method, it is necessary to re-enter in the laterals. An appropriate tool can be used to facilitate this re-entry (such as for operation with coiled tubing in multi-lateral wells). During lateral packing, the gravel slurry is pumped slowly through the tip of a pipe in the lateral while the pipe is pulled back slowly. Proper coordination between flow rate and pulling of the pipe is needed to insure full packing of the small lateral.

In the main well, the production interval can be protected in a number of ways as are described below.

Open-hole gravel packing and screens may be used. This corresponds to the situation of "Pack&Frac". It gives good PI contact to the reservoir with low production velocity to avoid damage in the packing.

Alternatively, expandable screens may also be used giving a wider bore for flow in the well.

Figure 6:
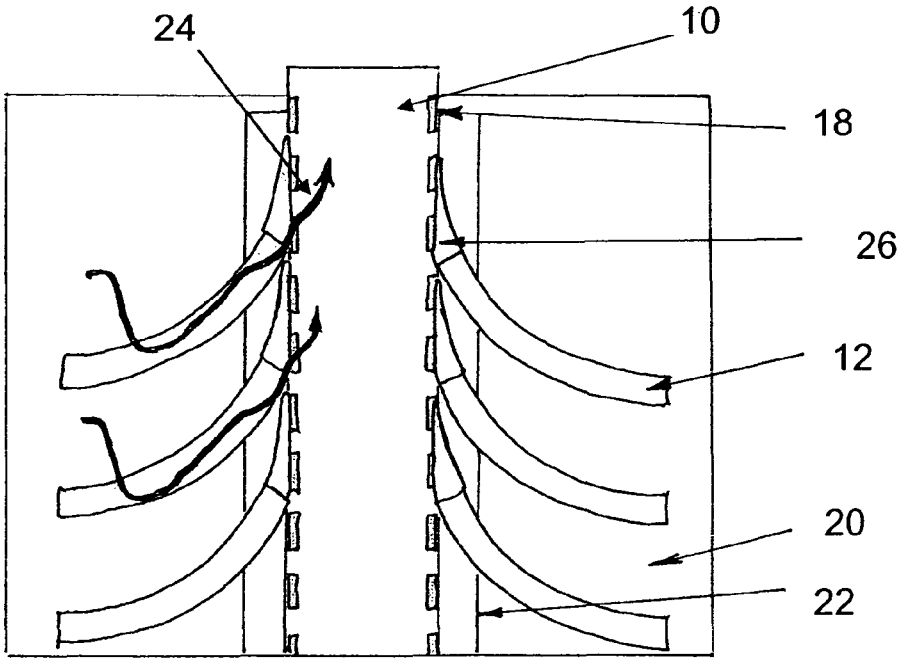
FIG. 6 shows completion of a well in accordance with another embodiment of the invention.

A slotted liner can also be used in combination with the small packed laterals as is shown in FIG. 6. The liner 18 ensures that the main well 10 does not collapse, for example because of the presence of an unconsolidated formation 20. In such a case, it may be necessary to ensure that the production only occurs via the small laterals 12. Without additional care, some production may be achieved directly via the surface of the main well 10 potentially leading to sand production with its associated risk. For the survival of the main well 10, a treatment of the near-bore 22 is performed to stabilize the formation in the vicinity of the main well-bore 10. This matrix treatment can be performed just after drilling the main well (before any laterals are drilled). An appropriate treatment fluid is placed at the desired interval in the main well 10. It is then injected in the formation 22 over the interval of the well, to stabilize the rock (increase its strength to erosion) or to seal it over a short depth (e.g. 1 foot/30 cm) to insure that production via the sand face is blocked (the production 24 will be via the laterals 12 which are treated near the junction 26 with the main well 10 to prevent production of the gravel).

Cemented casing in the main well. In this case, it is probably better to drill the small lateral after the installation of the casing.

The use of multiple small laterals without gravel packing may be an adequate solution for production where sanding normally occurs. It may not be necessary to pack the small lateral for the following reasons:

- reduction of the pressure drawdown thanks to a increase contact with the reservoir;
- lower fluid velocity in the vicinity of the small laterals; and/or
- high stability of the small well-bore thanks to the small diameter.

In horizontal wells, the well trajectory is not always perfectly horizontal or parallel to the water table (which lies below the oil-bearing zone). In some intervals, the distance between the well and the water table may be smaller than others. Water coning can appear quickly in this positions when open-hole production or slotted liners are used, or even with dense perforation schemes.

Figure 7:
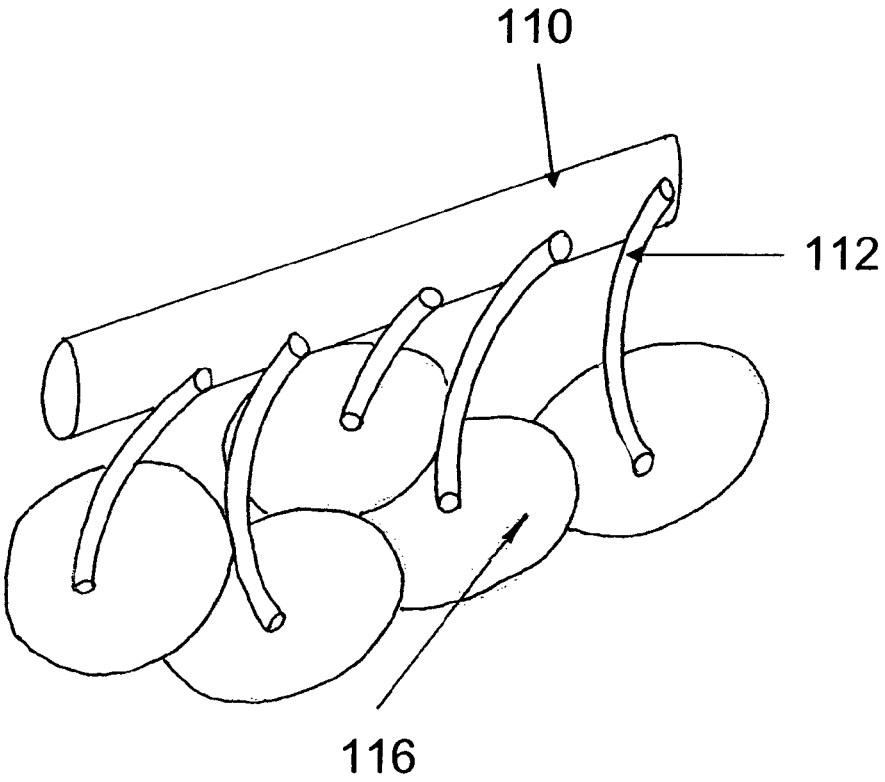
FIGS. 7-9 show construction of a horizontal well in accordance with an embodiment of the invention.
Figure 8:
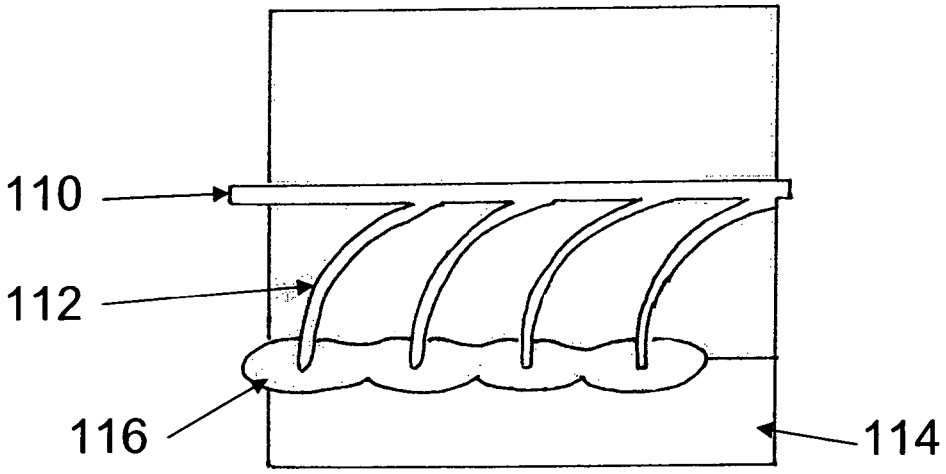
Figure 9:
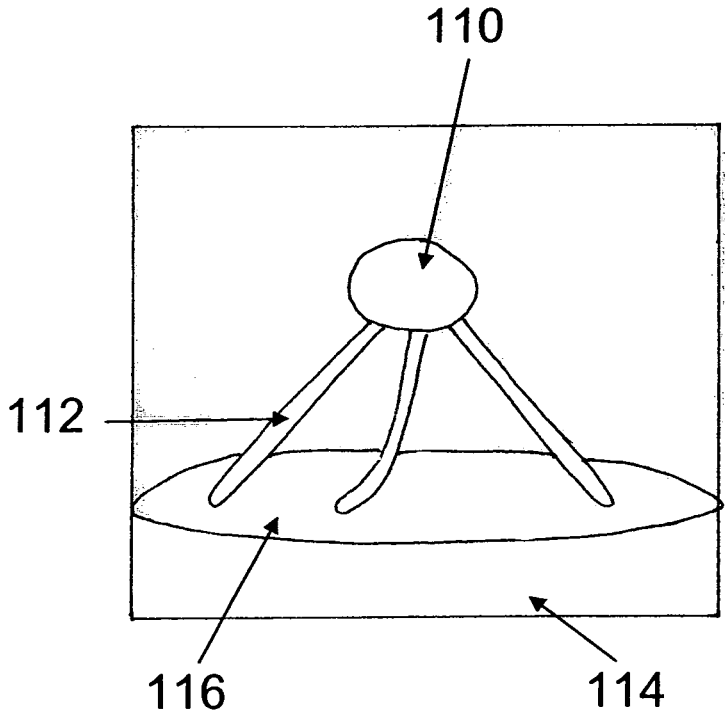

This problem can be addressed by the use of small laterals in accordance with the invention as is shown in FIGS. 7-9. Multiple small laterals 112 are drilled down from the parent well 110 towards the water table 114. A matrix treatment is then performed via the small laterals 112 to inject sealing product into the pores of the formation. The objective of these injections is to cerate a non-permeable disk 116 between the water table 114 and the well 110. These disks 116 would then form an impermeable layer which would limit the move upwards of the water.

These treatments are typically performed very early in the life of the well, for example just after drilling when the proximity of the water table is detected. However, treatment can also be performed later when production is performed in open-hole.

Figure 10:
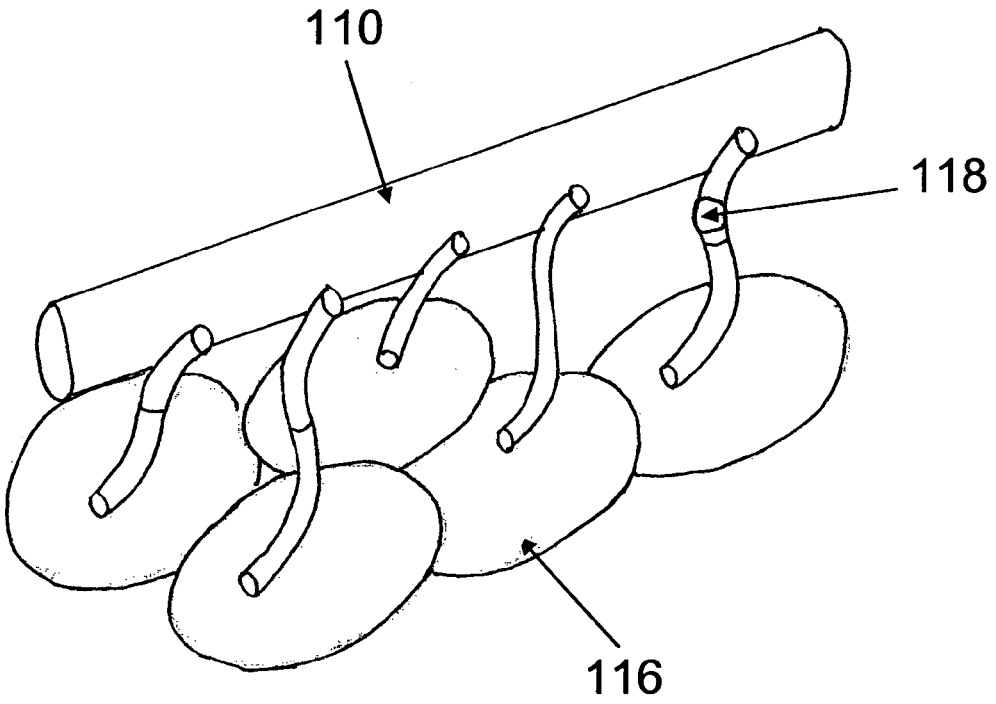
FIGS. 10 and 11 show another embodiment of construction of a horizontal well in accordance with the invention.
Figure 11:
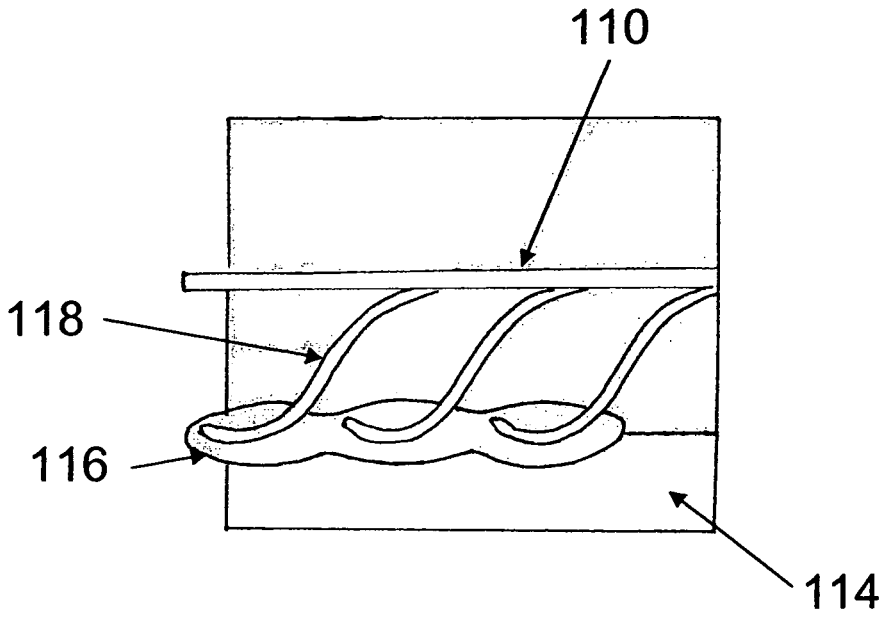

For this application, S-shape laterals 118 may be preferred as they would insure a better placement of the fluid in the formation as is shown in FIGS. 10 and 11.

With cased-hole, the lateral drilling is slightly more complex due to the opening of the window in the casing.

Techniques according to the invention can be used for water production management in horizontal wells. For example, the main (horizontal) well can be drilled at the top of the reservoir (or even above the reservoir) and multiple small laterals are then be drilled downwards to ensure good connection with the reservoir. These small lateral can be gravel packed (over their whole section) as explained above. The packing contains "conventional particles" such as those used in conventional packing or "pack& frac", but also contains materials which swell when in contact with water. This means that the lateral length in contact with the water (water table or water coning) would let the water be produced for a limited period. Then the swelling material blocks the permeability of the drain over the water wet interval. This ensures an automatic limitation of the water entry in the laterals (and in the main well).

In horizontal wells, the well may locally be close to the interface with the gas cap lying over the oil-bearing zones. In this case, there can be a risk of gas entering in the well which could then reduce the total well production capacity, as the gas may limit the well section involved with liquid production. Furthermore, the gas production into the main well may also cause rapid pressure reduction in the reservoir such that the natural flow will be reduced. The gas production in the peaks of the well trajectory is similar to the water production in the troughs and similar treatment can be applied to limit the gas coning effect.

As shown in the real field situations, horizontal wells may have troughs that are too close to the water table for proper connection to the oil-bearing part of the reservoir. It may be beneficial to apply the above technique (such as described in FIG. 11) locally in the troughs of the horizontal well to retract the local water coning effect.

In another embodiment of the invention, small laterals are drilled upwards to ensure drainage from higher zone of the oil-bearing formation.

Techniques according to the can also be used to address drilling problems. These include:

- High (total) loss of drilling fluid (including the case of lost circulation): this is often due to low pressure formation with high permeability or highly fractured layers;
- Well-bore influx from high pressure formation. In some cases, it may be difficult to increase mud density to reach the proper pressure equilibrium for the high pressure zones without fracturing other formations;
- Rupture of formation with inadequate mechanical properties. The rock may fail under "tensile" load (commonly called fracturing): one normal treatment is to reduce the mud density but this can lead to problems with well bore collapse as the well-bore hoop stress is too high (this is typical in horizontal wells); another normal treatment is to increase mud density but again, the mud density adjustment may be limited due to limitations by other formations.

It is often difficult to find the correct mud density to address all potential drilling problems and allow safe, effective drilling to continue. The ultimate solution is often to install a casing string to isolate the problem formation. However, casing is expensive and, the telescopic effect of successive casing strings makes it difficult to provide the correct well-bore size in front of the reservoir. In the worst case, the well may have to be abandoned as the drain is too small in diameter with too low productivity.

Figure 12:
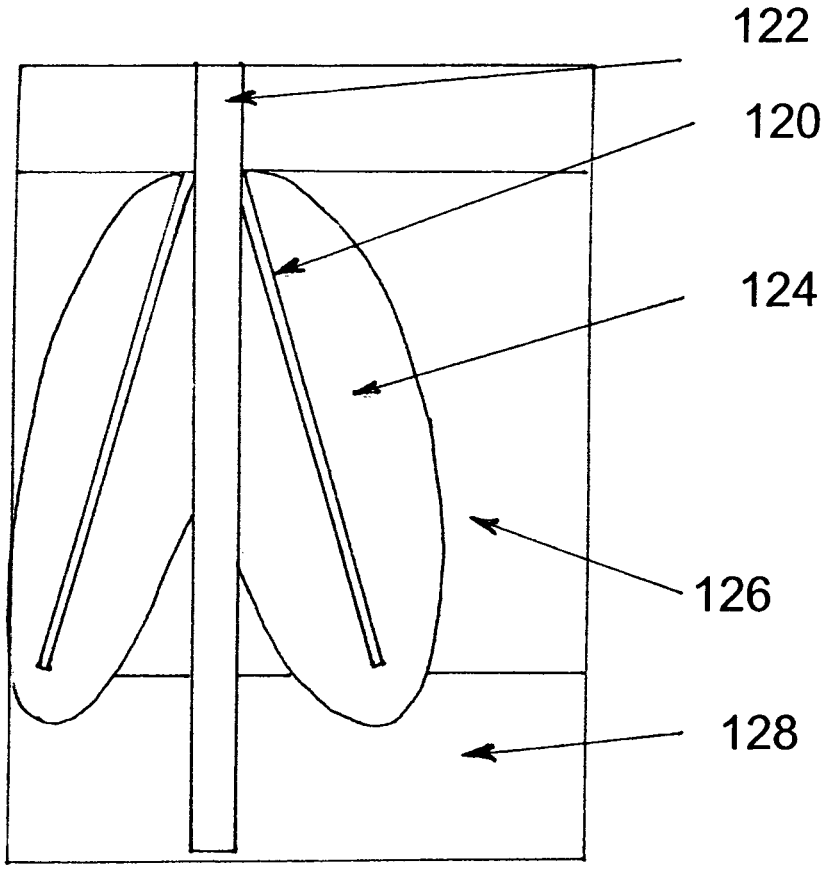
FIGS. 12 and 13 show treatment of a formation during drilling using a technique according to the invention.
Figure 13:
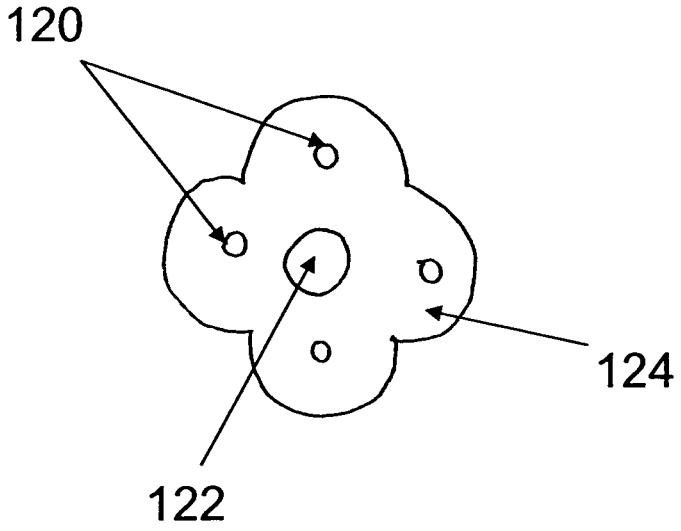

This invention allows combating of the problems in the critical formation in different ways. One embodiment of the invention involves drilling multiple small laterals 120 at a small distance from the main well bore 122 (see FIGS. 12 and 13). In this application the laterals 120 are only slightly deviated form the main well 122 (e.g. 5°). However several laterals are drilled at the same depth at different azimuths. Spiral laterals (such as are described above in relation to FIG. 4) can also allow the same result to be achieved. The small laterals 120 are being used to inject products into the formation 124 and seal or modify the formation strength compared to that of the untreated formation 126. Thus the problem formation 126 can be isolated from the normal formation 128 and allow further drilling to continue.

Different types of fluid can be injected (squeezed) into the formation, such as:

fine cement slurries (such as SqueezeCrete of Schlumberger) to block the pore and increase the rock strength;

polymers which flow in the rock pores and then solidify (while blocking flow and increasing rock strength); and gels to block the pores against flow and then break down after the proper triggering mechanism, including time (this approach may be interesting if the initial porosity and permeability need to be recovered after drilling has finished).

These treatments are typically performed as soon as the critical formation has being drilled.

Other changes within the scope of the invention will be apparent.

The invention claimed is:

1. A method of constructing a well, comprising:

drilling a main horizontal borehole;

drilling a plurality of lateral boreholes downward from the main horizontal borehole with trajectories that deviate less than 10 degrees from the main horizontal borehole into a formation, wherein the lateral boreholes are substantially shorter and of smaller diameter than the main horizontal borehole, and wherein each lateral borehole is separated from its neighboring lateral boreholes by an axial spacing in the main horizontal borehole of less than a few meters; and pumping a formation treatment fluid through the lateral boreholes and into the formation thereby creating a non-permeable barrier external of the lateral boreholes relative to the main horizontal borehole, thereby preventing the flow of water from the formation into the lateral boreholes.

2. The method of claim 1, comprising drilling the lateral boreholes so as to extend 5-60 meters from the main horizontal borehole.

3. The method of claim 1, comprising drilling the lateral boreholes so as to have a diameter in the range 3.8-10 cm.

4. The method of claim 1, comprising drilling the lateral boreholes so as to have an S-shape.

5. The method of claim 1, comprising drilling the lateral boreholes so as to extend through a region of modified formation properties surrounding the main horizontal borehole into a region beyond which has substantially bulk formation properties.

6. The method of claim 1, further comprising filling the lateral boreholes with gelled fluid after drilling so as to prevent contamination of the lateral boreholes with fluids from the main horizontal borehole.

7. The method of claim 6, further comprising breaking the gelled fluid in the lateral boreholes so as to obtain access to the interior of the lateral boreholes.

8. The method of claim 1, comprising substantially filling the whole of the lateral boreholes with gravel.

9. The method of claim 8, further comprising stabilizing the gravel at the region of the lateral boreholes close to the main horizontal borehole so as to prevent the gravel from passing into the main horizontal borehole.

10. The method of claim 1, further comprising filling each lateral borehole with gelled fluid or gravel immediately after it has been drilled and before another lateral borehole is drilled.

11. The method of claim 1, further comprising filling all of the lateral boreholes with gelled fluid or gravel one after the other following drilling of all of the lateral boreholes.

12. The method of claim 1, further comprising completing the main horizontal borehole in the region from which the lateral boreholes extend by means of a gravel pack and screen, an expandable screen, a slotted liner or cemented casing.

13. The method of claim 1, comprising pumping a treatment fluid from the main horizontal borehole into the formation to stabilize its mechanical properties during the drilling process.

14. The method of claim 1, wherein the plurality of lateral boreholes have diameters of 3.8 cm.

15. The method of claim 1, wherein trajectories of the plurality of lateral boreholes are nearly parallel to the main horizontal borehole.

16. The method of claim 1, wherein trajectories of the plurality of lateral boreholes deviate about 5 degrees from the main horizontal borehole.

17. The method of claim 1, wherein trajectories of the plurality of boreholes deviate less than 10 degrees from the main horizontal borehole.

* * * * *